US007252455B2

(12) United States Patent
Larsen

(10) Patent No.: US 7,252,455 B2
(45) Date of Patent: Aug. 7, 2007

(54) MULTI AXIAL ASPHALT HEATING SYSTEM WITH UP AND DOWN, FORWARD AND REVERSE ADJUSTMENTS AND FOLD UP FEATURE ADJUSTMENT

(76) Inventor: Gregory Alan Larsen, 35260 Rockwell Dr, Abbotsford, B.C. (CA) V3G 2C9

( * ) Notice: Subject to any disclaimer, the term of this patent is extended or adjusted under 35 U.S.C. 154(b) by 769 days.

(21) Appl. No.: 10/733,151

(22) Filed: Dec. 10, 2003

(65) Prior Publication Data

US 2006/0112951 A1 Jun. 1, 2006

(51) Int. Cl.
*E01C 23/14* (2006.01)

(52) U.S. Cl. ..... 404/95; 404/75; 404/77; 404/79

(58) Field of Classification Search ..... 404/75, 404/77, 79, 95
See application file for complete search history.

(56) References Cited

U.S. PATENT DOCUMENTS

| | | | | |
|---|---|---|---|---|
| 6,227,762 | B1 * | 5/2001 | Van Velsor | 404/95 |
| 6,742,959 | B2 * | 6/2004 | Strassman | 404/95 |
| 6,998,010 | B2 * | 2/2006 | Wiley | 156/309.6 |
| 7,033,104 | B2 * | 4/2006 | Corcoran | 404/77 |

* cited by examiner

*Primary Examiner*—Raymond Addie

(57) ABSTRACT

A multi axial asphalt heater for re-heating and recycling of old and new asphalt for permanent joint free repairs and restorations. It is possible to adjust the heating elements mechanically up and down off the asphalt surface with the lever arm mechanism. The provision of rotational movement of the heating elements permits the device to be retracted into a transport configuration. Forward and reverse motion of the heating elements permits a graduate heating process to be performed. The fold-up design with radially shaped adjustable hinges provide various angularity adjustments not only for compact convenience but also for establishing specific heat clearances, avoiding shut down delays and overheating.

9 Claims, 5 Drawing Sheets

MULTI AXIAL ASPHALT HEATING SYSTEM WITH UP AND DOWN, FORWARD AND REVERSE ADJUSTMENTS AND FOLD UP FEATURE ADJUSTMENT

BACKGROUND OF THE INVENTION

The present invention relates to re-heating and recycling of old and new asphalt for permanent joint free repairs. The prior art is replete with designs having a portable Multi axial Infrared heating system supported on pneumatic wheels. Various mechanisms have been devised for adjusting the three separate infrared heating banks. The adjustments of the infrared heating banks requires a series of adjustment steps; For example there is forward and reverse movement, up and down movement and fold up feature. A primary object of the present invention is to provide in association with a compact Fold up Design, an adjustable mechanism that permits precise Heating Adjustments for various climatic temperature situations and asphalt conditions.

REFERENCES CITED

U.S. Patent Documents

U.S. Pat. No. 5,114,284 May 19, 1992 Keizer 404/95, 96;

An extensive search of U.S. patent resulted in numerous asphalt-heating unit but non-if any with close similarity. The example given U.S. Pat. No. 5,114,284 is a fold up design with a typical stationary heating bed.

SUMMARY OF INVENTION

The Multi axial designed asphalt heater generally designated in FIG. 5 represents an example of the practical use and ability of the present invention. It is an example of a asphalt heating system Multi axial design that can safely and precisely heat a large or small area of old or new asphalt "Soften" it to a workable state without damaging the asphalt surface, plus offer fold up compact convenience. In theory and practicality the non stationary heating elements with forward and reverse rotation 310 allows the asphalt surface to heat on a graduated scale, each pass of the heating element increases the asphalt temperatures and allow graduating heat penetration. In another aspect of the present invention there is provided a method of adjusting the heating elements mechanically up and down off the asphalt surface with the mechanical lever arm 35. With forward and reverse motion of the mechanical lever arm 35 urge rotation 30*b*, 30*a* and lift or decent of the main body, extending track rails and heating elements. Yet another object of the present invention FIG. 5*a* is to provide in association with a fold up feature a means of positioning or adjusting angularity the outer extending heating elements. The various positional adjustments angularity upward provides exact heat clearances, avoids overheating and shut down delays. From the practical point of view the Multi Axial design of the present invention provides multi adjustments for precision heating of asphalt in all conditions.

DETAILED DESCRIPTION

Figure 1:
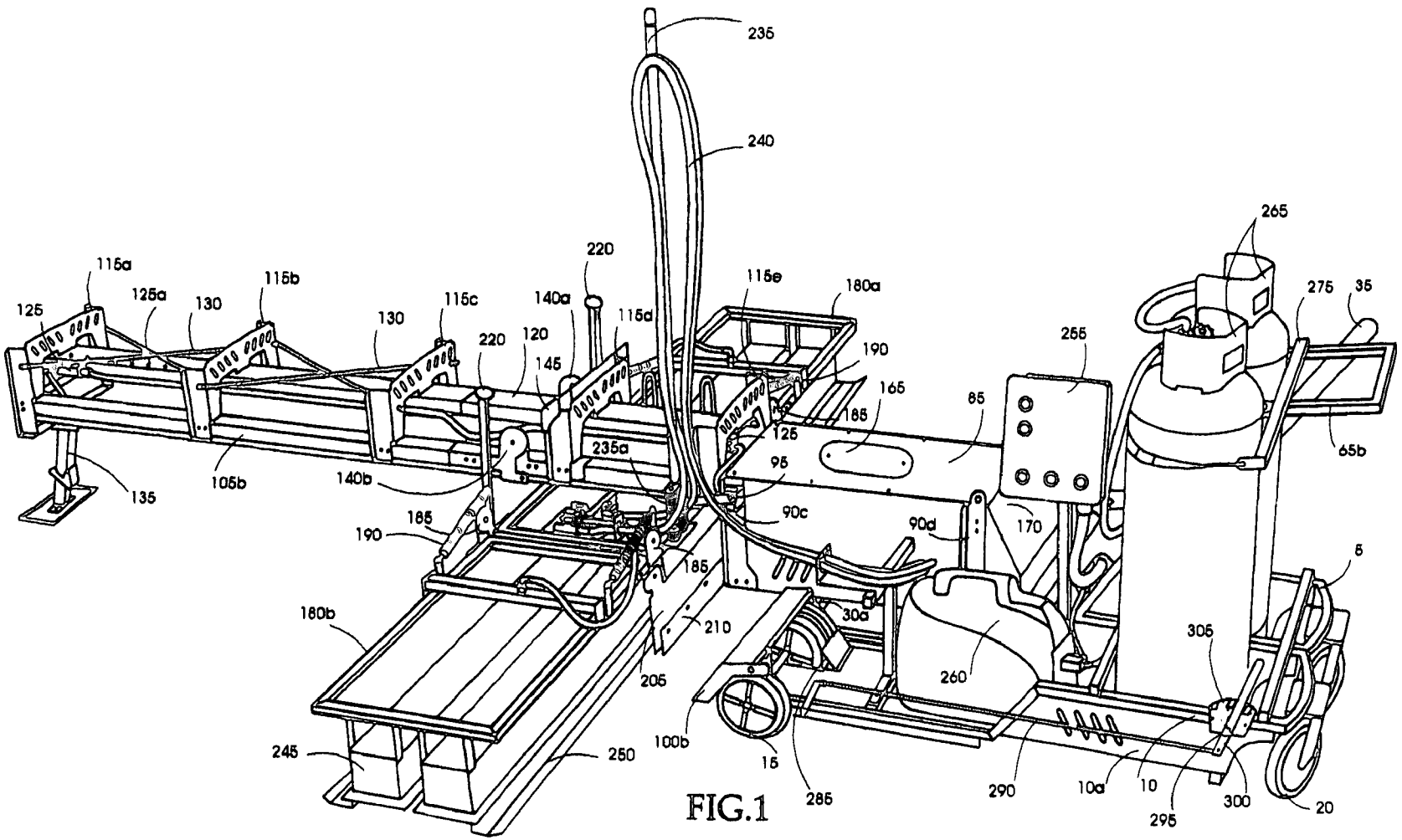
FIG. 1 is a perspective left view from an elevated rear vantage plane of the side and top. This view illustrating the initial orientations of the invention in the fold out, full length and width positions in accordance with the present invention.
Figure 2:
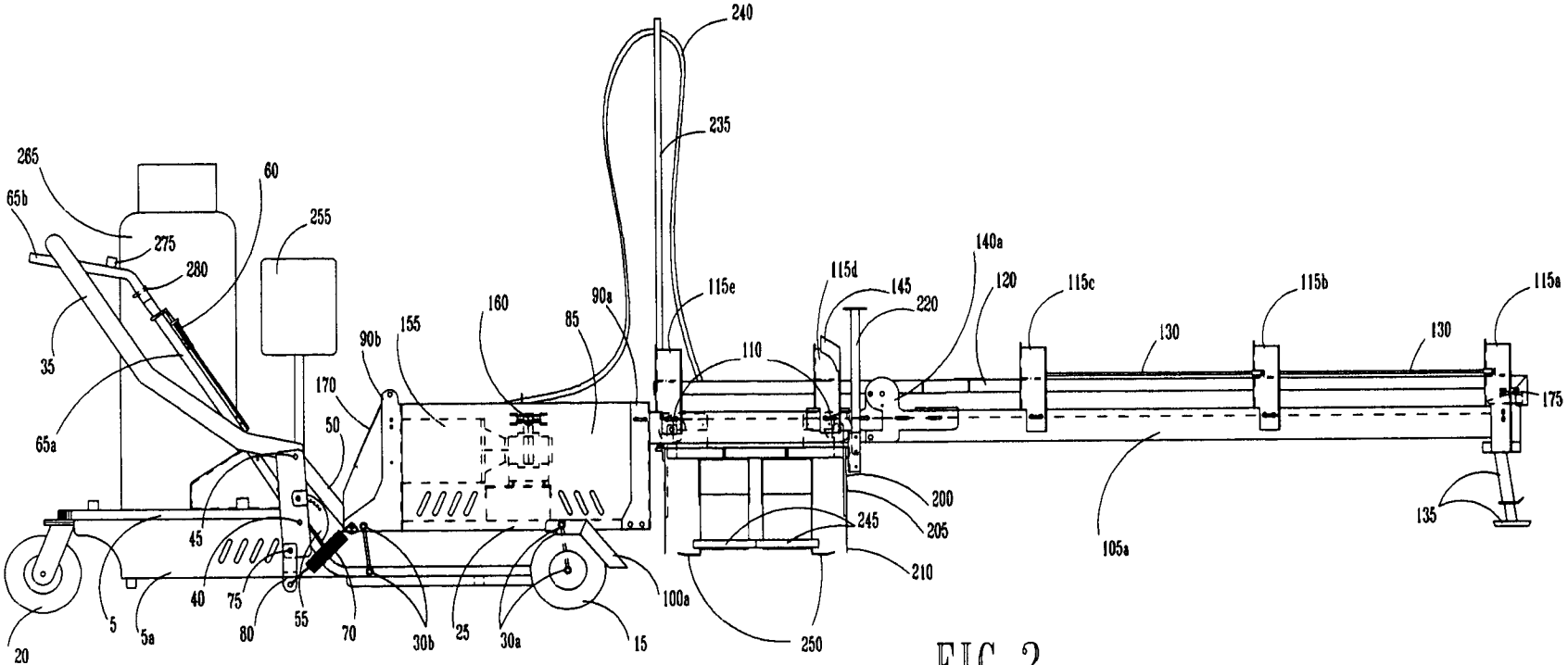
FIG. 2 is a detailed right side view, partially cut-away taken in a plane perpendicular to the invention in accordance with the invention.
Figure 3:
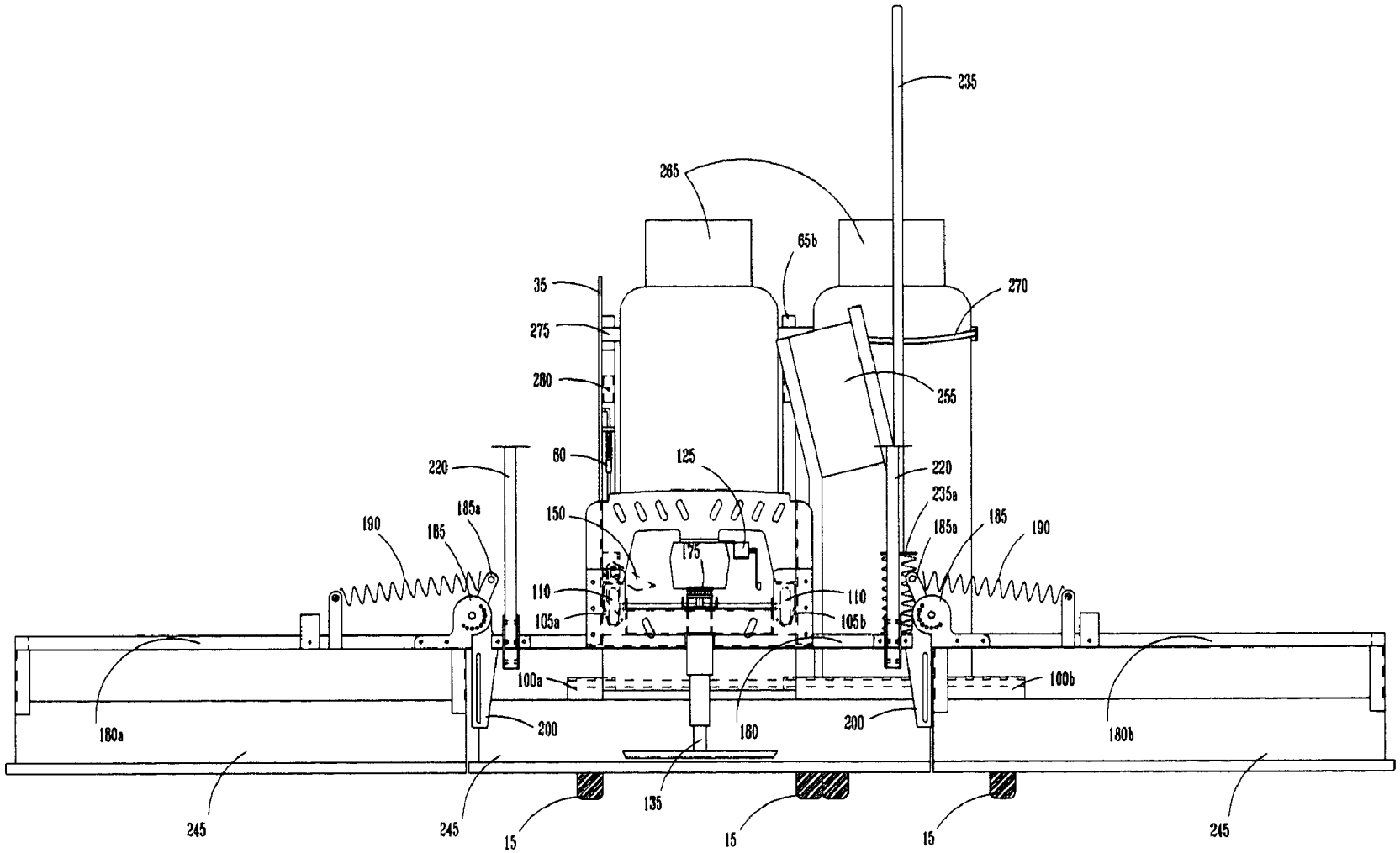
FIG. 3 is a front detail view, partially cut-away taken in a plane perpendicular to the invention. Some detail that appears in FIG. 1 wind guard, propane hoses, element baffles have been removed for the purpose of illustrations.
Figure 4:
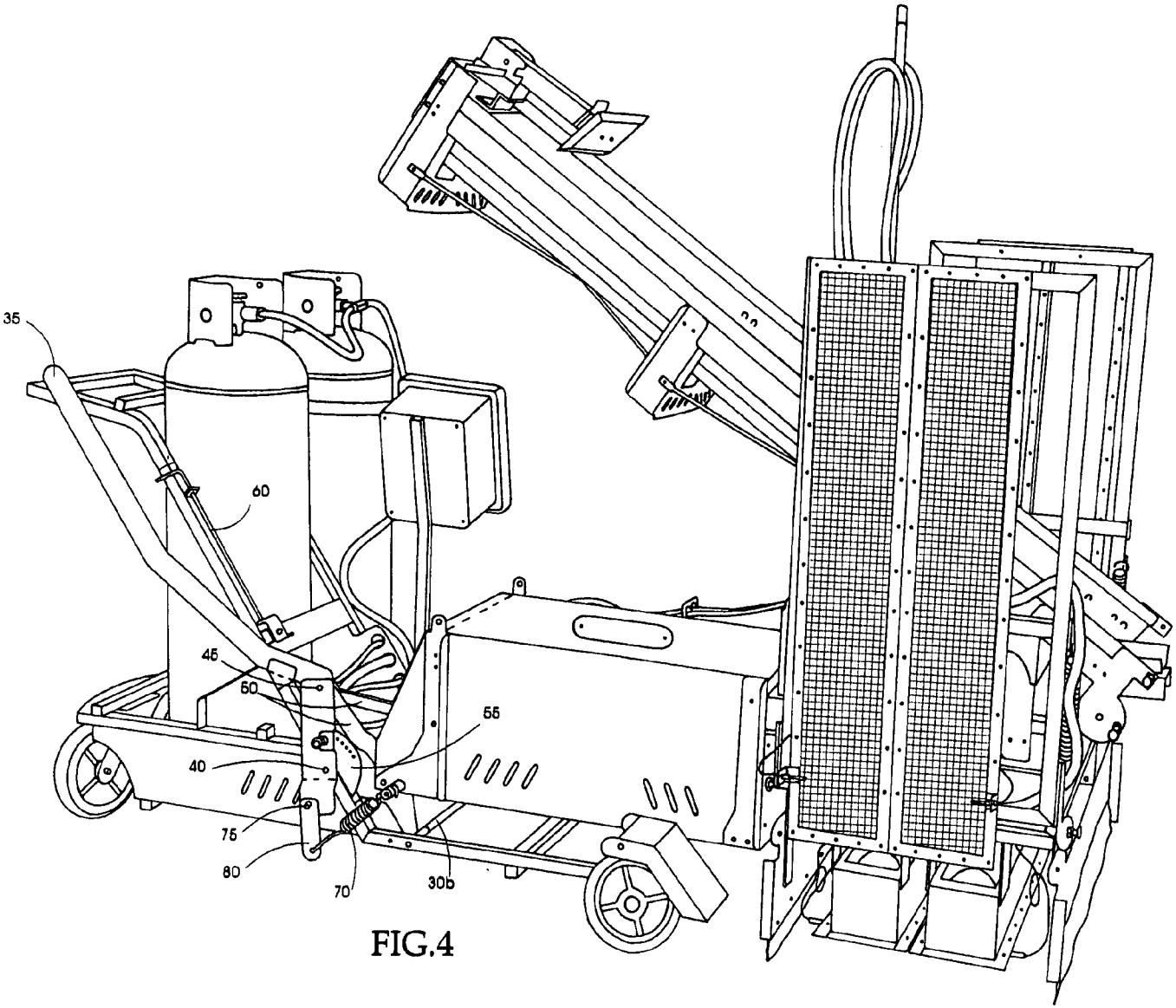
FIG. 4 is a perspective right view from a slightly elevated front vantage plane of the side and top. This View illustrating the invention in the fold up position. Representational view showing Detail section view of the adjustment mechanism up and down. Some detail that appears in FIG. 1 element baffles has been removed for the purpose of illustrations.
Figure 5:
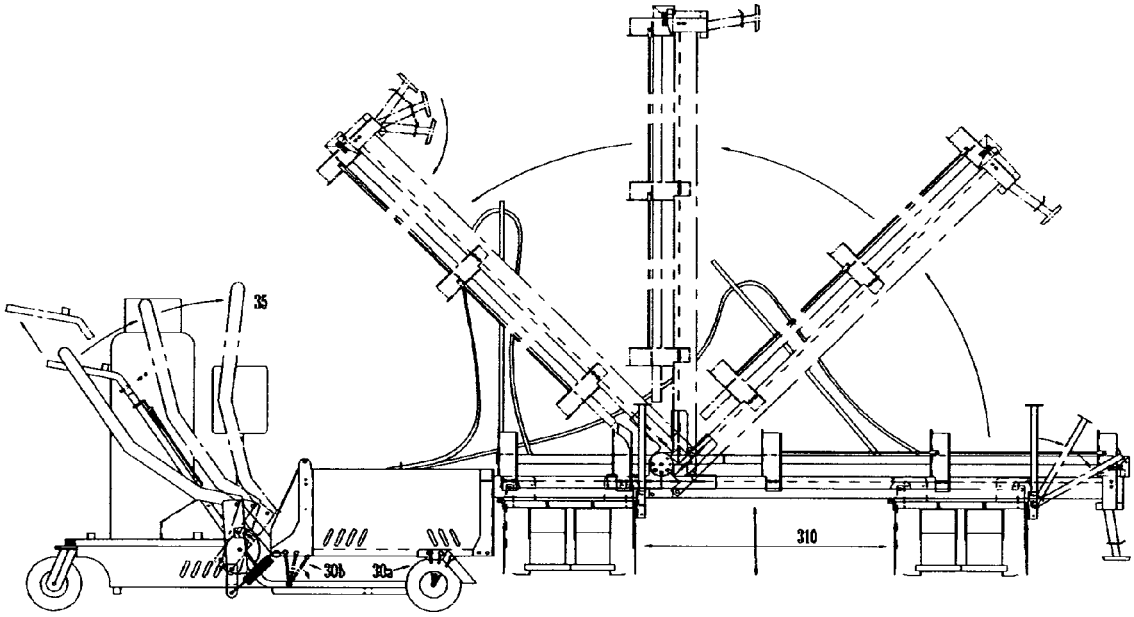
FIG. 5 is a right side view taken in a plane perpendicular to the invention. It is a representational view showing the tending direction of linear movement of the Multi axial design as a function of its rotation and orientation of the ability.
Figure 5A:
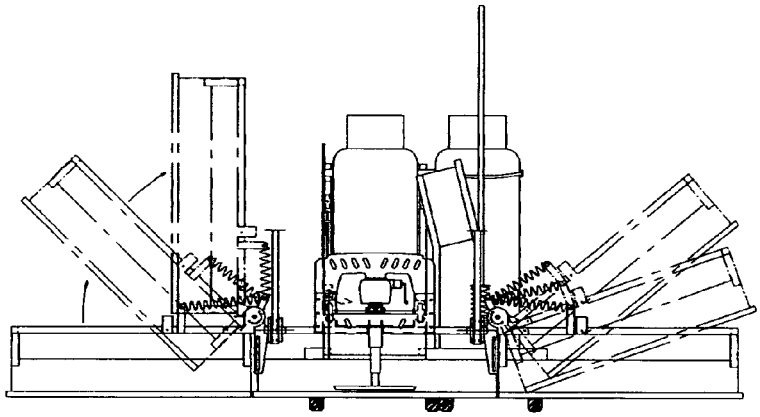
FIG. 5*a* is a front detail view taken in a plane perpendicular to the invention. It is a representational view showing the tending direction of linear movement of the Multi axial design as a function of its rotation and orientation of the ability.

In a broad aspect of the present invention there is provided a main frame base 5 with a sheet metal pan enclosure 5*a* and side supporting frame base 10 with a sheet metal pan enclosure 10*a* and pneumatic wheels 15 extending forward and extending to the rear pneumatic swivel casters 20 with locking devises. Extending upwardly from the main frame base 5 is an upper portion 25 pinned mounted atop the lower portion the main frame base and is rotatably mounted on the upper portion and lower portion for rotation about a pin 30*a*, 30*b* axis. The upper portion 25 of the main frame base 5 is constrained to rotate relative to the lower portion the main frame base. Adjustment to the desired position of rotation may be achieved by the adjustment mechanism or lever arm 35 mounted to the lower portion extending upwards about the skew axis center bolt 40. A bolt 45 connected to lifting arms 50 aligned on a common axis extends tangentially in relation to the axis center bolt 40. With the adjustment mechanism or lever arm 35 connected on common axis with forward and reverse motion urge rotation and lift or decent of upper portion relative to lower portion. When a desired position of adjustment has been achieved it may be secured such as with a spring pin method along the tangentially side adjustment plate 55 mounted to lower main frame base 5 or may be secured and locked using the spring loaded locking mechanism 60 attached to the handle 65 extending upward from the main frame base. The adjustment mechanism or Lever arm 35 embodiment the use of a heavy spring 70, a resistance mechanism from lower portion the main frame base 5 to upper portion 25. From the skew center bolt 40 extending downwards is a bolt 75 connected to a rotational resistance arm 80 which causes a delay in resistance. From the upward portion 25 of the main frame is a sheet metal enclosure covering top, two sides and front referred to as the main body 85. Mounted on the Four Comers and exterior of the main body are additional braces 90*a*, 90*b*, 90*c* 90*d*, for added strength and body support. An arm extending forward from brace 90*c* secures and locks in place the center heater frame 95. Also extending left and right off the upward portion 25 of the main frame base and main body 85 are the fenders 100*a*, 100*b* which are rotational secured about a pin axis 30*a*. Extending forward from the upward part of the main body 85 is the track rail mechanism 105*a*, 105*b* a left and right side with a radially shaped channel base designed for carrying and supporting radially shaped rollers 110 for rotation extending the full length of the track rail. From the track rail mechanism upwards are the truss mechanism 115*a*, 115*b*, 115*c*, 115*d*, 115*e* for confining and centering the track rail 105*a*, 105*b* and supporting the belt guard 120 with limit switches 125 attached on either ends, 125*a* (holes) provide adjustment, closing or opening the distance between the limit switches. Cross bracing 130 attached to trusses 115*a*, 115*b*, and 115*c*, provides anti twisting and side play integrity. A support post and a base pad 135 mounted at the far end of the track rail extending downwards adjust up and down and Folds inwards providing end track rail support Radially shaped Hinge mechanism 140*a*, 140*b* mounted left and right on a given point of the track rail mechanism 105*a*, 105*b* enables the track to lock in a level position, using a spring pin method or rotate upwards vertically and backwards resting on a adjustable cross beam mechanism 145 attached to truss 115*d*. Mounted to the inside of the radially shaped hinge mechanism 140*a* is a spring loaded safety, locking arm mechanism 150 which drops downward and over the track opening during the rotation upwards of the track mechanism insuring the center heater frame and heater banks stay lodged in position. As shown in more detail FIG. 2 the rotation cycles of the heating elements forward and reverse is powered electrically with a electric motor 155 and gear reduction mechanism 160 mounted atop the upper portion 25 of the main frame base and is confined with in the thin metal exterior sheeting of the main body 85. The electric motor and gear reduction mechanism and cog sprocket is assessable through a top inspection plate 165 or through a hinged rotational door 170 at the rear of the main body 85. Extending forward from the gear reduction mechanism and the cog sprocket, is a cog belt drive system connected on either ends of the center heating frame with an idler pulley 175 located at the far end of the track. The rotation cycle and travel distance forward and reverse is controlled and is adjustable by limit switches 125 mounted on either ends of the belt guard 120 and opposing ends of the track. From the track 105*a*, 105*b* down wards is the center heater frame 180 it is supported and suspended by the radially shaped carrying rollers 110. As shown in more detail FIG. 3 the Heater Frames consist of the center frame 180 and a flame to the right 180*a* and from the center frame a frame to the left 180*b* connected to each other by radially shaped hinge mechanisms 185 which embodiments the use of spring resistance mechanism 190 anchored from the radially shaped hinge arms 185 attached to the center heater frame extending outwardly to anchor brackets located on the left and right heater frames. The radially shaped hinges 185 offers rotation of the right 180*a* and left 180*b* not the center heater frames 180 up wards with periodically degree adjustment settings 195 to the vertical position. The one half of the radially shaped hinge 185 that is attached to the center frame skew downwards has a slotted flat metal mechanism 200 to attach and adjust the height of an optional wind guard device 205 flat plates extending from left to the right located front and rear of the heating frames with a sewn lower flexible snap on skirt 210. Attached to The center heater frame 180 skew forward are stabilizer legs 220*a*, 220*b* rotational up and down position by method of a center pin 225 and locking pin 230. Extending upwardly from the rear left corner of the center heater frame 180 is a mechanism referred to as the hose whip 235 a device that is spring mounted at the base providing Flexibility, offers resistance and support for the Propane hose 240 during travel between the limit switches mounted on the belt guard on either end of the track From the heater frames downward are the actual heating elements 245. These heating element are constructed using a stainless steel material and a bank as described consists of two heating elements joined side by side to form a singular bank The center bank two heating elements are supported by the center heating frame, the right bank two heating elements are supported by the right heating frame and the left bank two heating elements are supported by the left heating frame. Various mechanism have been devised from the heating element downwards are heat element baffles 250 on either sides of the heat element banks. These unique baffles safeguards against flame out of the heating elements during windy conditions and provide heat protection for thermocouples.

Extending upwards from the side supporting frame is the main electrical control panel 255. From the electrical control panel extending downwards and resting atop the side supporting frame base 10 is the electrical source a gas-powered generator 260. Extending upwards from the rear portion of the main frame 5 base and the side supporting base 10 is the heating element fuel source two vertically placed propane tanks 265. The upper rear portion of the handle 65*b* provides the stability for the two propane tanks by method of a secure strap 270 and a cross bar extending left and right 275. Exchange of the two propane tanks is accomplished by releasing the pins 280 located on either side of the handle 65*a*, 65*b* and removing the rear portion of the handle 65*b* and cross bar enabling free unobstructed access. Rotational braking mechanism 285 is a steel pad pin mounted designed to apply compression against the pneumatic wheels. The rear braking lever 300 has a center axis bolt 295 with spring retention allowing the braking lever 300 side to side and forward, reverse movement. The desired lock, unlock settings for braking are achieved with the tangentially side mounted plate 305 with extruded tabs. Rotational movement is transferred from the rear braking lever to the front steel pad with 290 the push, pull connecting rod.

A variety of modifications, changes and variations to the invention are possible within the spirit and scope of the following claims and will undoubtedly occur to those skilled in art The invention should not be considered as restricted to the specific embodiment that has described and illustrated with reference to the drawings.

What is claimed:

1. A portable, walk behind, pavement heater, having a self-contained fuel source and a wheeled frame, the pavement heater comprising:

A heating assembly having multiple heating elements pivotable about respective pivot axis from a retracted, transport configuration, to an extended operational configuration; as well as, A track rail extending along a longitudinal centerline of the pavement heater and a;

Motorized trolley, connect to the heating assembly, and having a reduction gear mechanism, for selectively moving the heating assembly fore and aft, along the track rail;

A track rail pivot assembly, to permit the track rail to be pivoted upwardly and rearwardly, into a retracted position, and pivoted downwardly into an operating configuration.

2. The pavement heater of claim 1, wherein the heating elements comprise stainless steel.

3. The pavement heater of claim 1, wherein the wheeled frame comprises pneumatic swivel casters.

4. The pavement heater of claim 3, wherein the pneumatic swivel casters further comprise locking devices.

5. The pavement heater of claim 1, wherein the heating elements include baffles that safeguard against flame outs during windy conditions and provide heat protection for thermocouples.

6. A portable, walk behind, pavement heater, having a self-contained fuel source and a wheeled frame, the pavement heater comprising:

A heating assembly having multiple pivotable heating elements; the heating assembly further comprising:

A pivotable track rail extending along a longitudinal centerline of the pavement heater;

A motorized trolley, connect to the heating assembly, and having a reduction gear mechanism, for selectively moving the heating assembly fore and aft, along the track rail, At least one lever arm, operatively connected to the heating elements, and are manually manipulated to both raise and lower the heating assembly relative to the surface being heated.

7. The pavement heater of claim 6, wherein motion of the motorized trolley is controlled with respect to direction and speed, thereby controlling the duration and of heating applied to the surface to be heated.

8. The pavement heater of claim 7, wherein the distance of travel of the motorized trolley can be controlled in a cyclical manner selectively controlled by at least one limit switch.

9. The pavement heater of claim 8, wherein the position of the at least one limit switch is selectively adjustable, thereby controlling the cyclical distance traveled by the motorized trolley.

* * * * *